US005201306A

United States Patent [19]

Kinny

[11] Patent Number: 5,201,306

[45] Date of Patent: Apr. 13, 1993

[54] ARRANGEMENT FOR SECURING A DROP-IN DEVICE TO A FIXED SUPPORT

[75] Inventor: David L. Kinny, Louisville, Ky.

[73] Assignee: General Electric Company, Louisville, Ky.

[21] Appl. No.: 761,165

[22] Filed: Sep. 9, 1991

[51] Int. Cl.[5] ..... F24C 15/10

[52] U.S. Cl. ..... 126/214 A; 126/214 R; 219/459; 219/467; 4/649; 312/243

[58] Field of Search ..... 126/214 R, 214 A; 4/633, 634, 649; 312/243; 362/365; 219/443, 445, 446, 458, 459, 467

[56] References Cited

U.S. PATENT DOCUMENTS

| | | | |
|---|---|---|---|
| 2,565,982 | 8/1951 | McMurtris | 126/214 A |
| 2,593,033 | 4/1952 | Johnson | 248/27.1 |
| 2,629,880 | 3/1953 | Fartog | 4/187 |
| 2,670,919 | 3/1954 | Esoldi | 248/27.1 |
| 2,831,955 | 4/1958 | Sheidler | 219/445 X |
| 2,846,558 | 8/1958 | Mason | 126/214 A |
| 2,887,103 | 3/1959 | Reeves | 126/214 A X |
| 3,011,849 | 12/1961 | Bishop, Jr. | 4/633 X |
| 3,354,474 | 11/1967 | Cairns et al. | 4/187 |
| 3,412,727 | 11/1968 | Hurko | 126/211 |
| 3,480,344 | 11/1969 | Goodridge | 312/242 |
| 3,679,870 | 7/1972 | Opp | 219/445 |
| 3,701,171 | 11/1972 | Fritzsche | 4/187 |
| 3,924,602 | 12/1975 | Irwin | 126/214 A |
| 3,947,652 | 3/1976 | Cobb | 219/10.79 |
| 4,318,537 | 3/1982 | Dorman et al. | 269/302.1 |
| 4,432,106 | 2/1984 | Smith | 4/633 |
| 4,779,605 | 10/1988 | Smith et al. | 126/33 |

FOREIGN PATENT DOCUMENTS

| | | | |
|---|---|---|---|
| 562445 | 8/1958 | Canada | 362/365 |

*Primary Examiner*—Carl D. Price

[57] ABSTRACT

A cooktop has its body disposed within a rectangular shaped opening in a counter top. The body has upper front and rear flanges larger than the opening in the counter top to rest on the counter top. The cooktop has two slidably mounted clamping brackets on its bottom surface with one at its front edge and the other at its rear edge. Each clamping bracket is releasably held in a retracted position within the periphery of the bottom surface of the cooktop during insertion of the cooktop into the opening. Each clamping bracket has two elongated slots through which two screws extend into two holes in the bottom surface of the cooktop. After the cooktop is inserted within the opening in the counter top, the two screws for each clamping bracket are loosened, and each clamping bracket is moved to an extended position with its maximum being the length of the elongated slots. Each clamping bracket has a nut to receive a long screw. Each long screw is rotated through the nut on the clamping bracket until it engages the bottom surface of the counter top to prevent movement of the cooktop. More than one of the cooktops may be disposed adjacent each other in the opening.

20 Claims, 1 Drawing Sheet

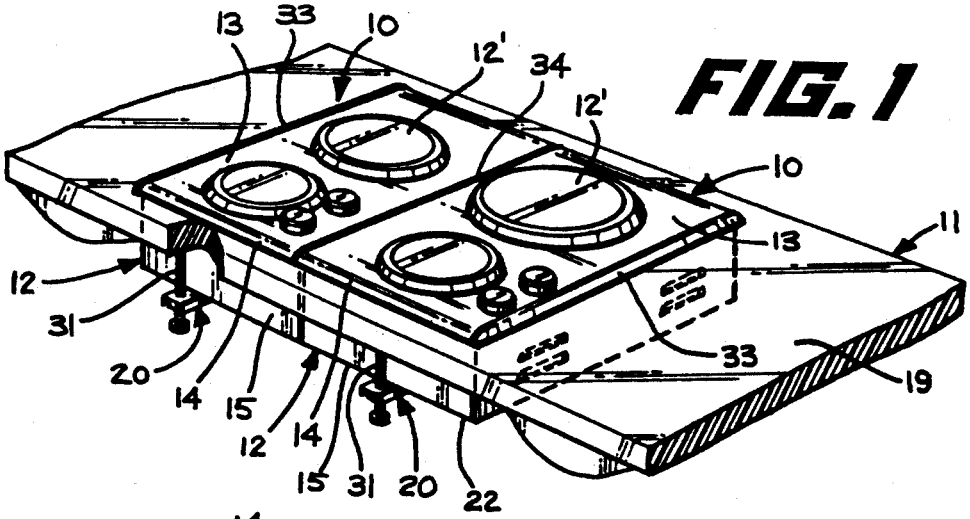
FIG. 1
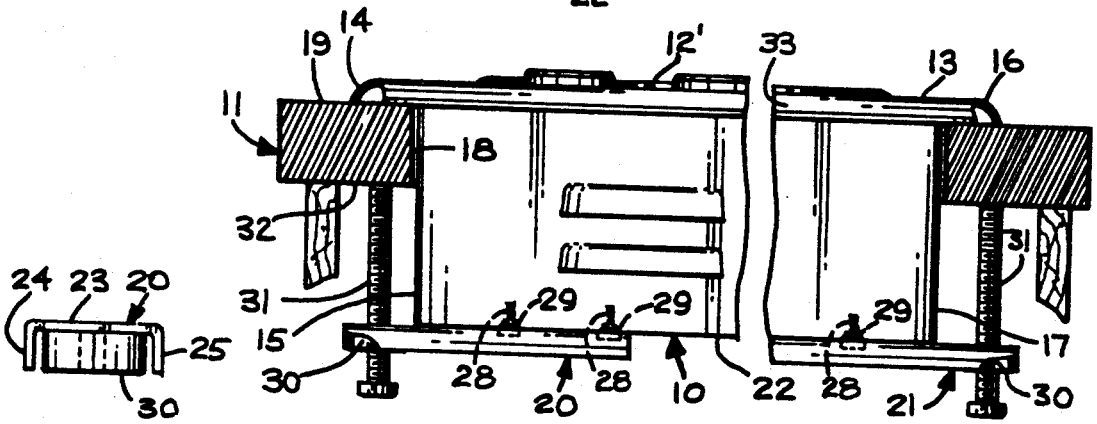
FIG. 5
FIG. 2
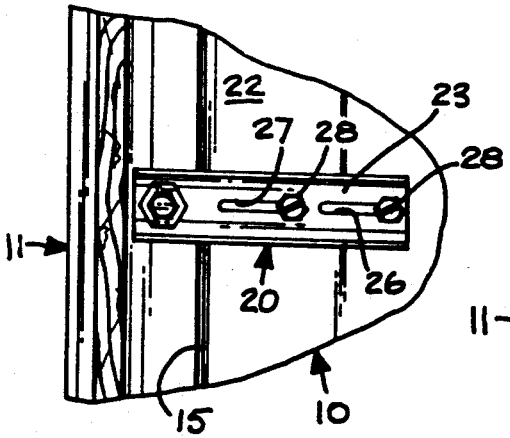
FIG. 3
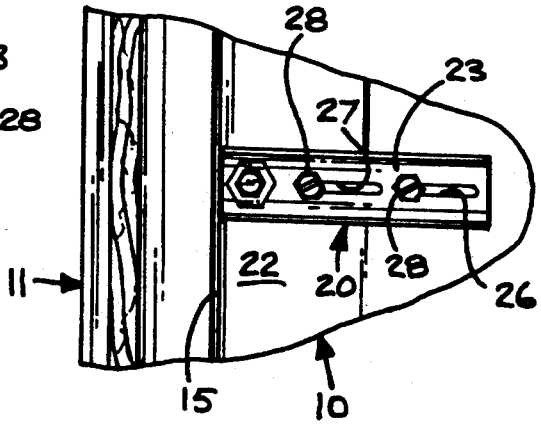
FIG. 4

ARRANGEMENT FOR SECURING A DROP-IN DEVICE TO A FIXED SUPPORT

FIELD OF THE INVENTION

This invention relates to an arrangement for securing a drop-in device which is disposed within an opening in a fixed support to the fixed support and, more particularly, to an arrangement for securing a cooktop which is disposed within an opening in a counter top to the counter top.

BACKGROUND OF THE INVENTION

When a built-in cooktop is disposed within an opening in a counter top, it is necessary to insure that the cooktop sits flat on an upper support surface of the counter top and is not movable relative thereto. After the opening is formed in the counter top and the cooktop is inserted into the opening, the installer must then secure the cooktop to the counter top to prevent movement of the cooktop relative to the counter top.

One previous arrangement for securing a cooktop to a counter top has been to form slots in the lower portion of the cooktop's outer wall during manufacture. After the cooktop is disposed within the opening in the counter top, an L-shaped clip is positioned within each of the slots. Each of the clips has one leg inside of the cooktop's outer wall and extending upwardly from the inner end of its other leg, which extends horizontally and has a threaded hole extending therethrough. A screw is driven through the threaded hole in the horizontal leg of the clip until it engages a bottom surface of the counter top.

Installation is awkward because the installer must hold the L-shaped clip with one hand through grasping the horizontal leg while driving the screw with the other. In cramped conditions, this can be impossible.

Another prior arrangement for securing a cooktop to a counter top in which the cooktop is disposed within an opening in the counter top has been to emboss the bottom wall of the cooktop so that the embossed portion of the bottom wall of the cooktop is at an angle to the remainder of the bottom wall of the cooktop and to the outer side wall of the cooktop. A nut is welded to the interior of the embossed portion of the bottom wall so that the nut is at an angle to the bottom and side walls of the cooktop. Then, an opening has been formed in the outer side wall of the cooktop so that a screw extends through the nut, which is welded to the embossed portion of the bottom wall, and the opening in the outer side wall of the cooktop at an angle to the outer side wall of the cooktop to engage a surface of the counter top. This is a complicated arrangement and increases tooling costs. The screw also is at an angle to the surface of the counter top that it engages.

U.S. Pat. No. 3,701,171 to Fritzsche discloses a work surface clamping means for drop-in cooking equipment. The aforesaid Fritzsche patent has the disadvantage of increasing the manufacturing costs of the drop-in cooking equipment through requiring an outwardly projecting flange to be welded to the bottom wall of the drop-in cooking equipment along all sides of the drop-in cooking equipment. The outwardly projecting flanges, which are welded to the bottom wall of the drop-in cooking equipment, extend beyond the outer wall of the drop-in cooking equipment so as to require a larger opening in the work surface; this enlarged opening allows much more play between the outer wall of the drop-in cooking equipment and the work surface so that the possibility exists for motion of the drop-in cooking equipment relative to the work surface.

U.S. Pat. No. 3,354,474 to Cairns et al has an arrangement for securing a plumbing fixture to a support having an opening through which the plumbing fixture extends. The plumbing fixture of the aforesaid Cairns et al patent has a plurality of clamping devices mounted on the bottom surface of its upper rim. Each of the clamping devices includes a pair of parallel vertical members connected at their upper ends by a top member, which is secured to the upper rim of the plumbing fixture. The two parallel vertical members also are connected by a horizontal bottom member at the bottom of the shorter of the two parallel vertical members. A clamp plate is pivotally mounted on the connecting bottom member for pivotal movement through 90° with the parallel vertical member, which extends beneath the horizontal bottom member, having a slot therein to stop pivoting of the clamp plate at 90°. The clamp plate support a screw for engaging a bottom surface of the support having the opening in which the plumbing fixture is disposed.

While the clamping arrangement of the aforesaid Cairns et al patent has the clamping devices inside of the periphery of the upper rim when inserting the plumbing fixture within the opening in the support, the upper rim is substantially larger than the fixture to provide room for the clamping devices so as to require an opening substantially larger than the plumbing fixture's outer wall. Because of the pivotal arrangement of the clamp plate, there is no further requirement for enlarging the opening beyond that required for the clamping devices. However, this arrangement for the clamping devices requires a substantially larger opening in the support. Additionally, because of the relatively large opening, there can be play of the plumbing fixture whereby there can be pivoting of the plumbing fixture from its desired position because of the pivotal arrangement of the clamp plate on the horizontal bottom member of the clamping device.

The present invention overcomes the problem of the opening in the support for the cooktop having to be substantially larger than the outer walls of the cooktop. The present invention also eliminates the problem of the cooktop pivoting with respect to its clamping means, as can occur in the aforesaid Cairns et al patent, through utilizing slidably mounted means to support engaging means for engaging a bottom surface of the counter top.

The present invention satisfactorily solves the foregoing problems through providing slidably mounted retaining means on opposite sides of the bottom surface of the cooktop. Each of the two retaining means is retained within the periphery of the bottom surface of the cooktop during insertion of the cooktop into the opening in the counter top. Each of the retaining means is slidably movable from its retracted position a selected distance, up to a maximum, beyond the periphery of the cooktop. Each of the retaining means has threaded support means to receive a threaded member for engagement with the bottom surface of the counter top.

There is no relative pivotal motion between the retaining means and the cooktop or the threaded member. Thus, if the opening in the counter top is too large, there is no play of the cooktop relative to the counter top. There also is no need to have the opening enlarged for any clamping structure extending beyond the periphery of the portion of the cooktop inserted within the opening in the counter top.

It is necessary for the clamping device to be adjacent each of the edges of the cooking equipment in the aforesaid Fritzsche patent and the plumbing fixture in the aforesaid Cairns et al patent. This arrangement prevents positioning two units adjacent each other in the same opening. By mounting the retaining means adjacent the front and rear edges of the bottom wall of the cooktop, the present invention can have more than one of the cooktops placed adjacent each other in a single opening in the counter top. Thus, there is no need for spacing between the cooktops, and this arrangement permits a plurality of the cooktops to be disposed adjacent each other when desired.

SUMMARY OF THE INVENTION

The arrangement of the present invention for securing the drop-in device, which is disposed in an opening in a fixed support, to the fixed support includes a body, which is smaller than the opening in the fixed support, having an upper portion larger than the opening for engaging an upper support surface of the fixed support. The body has two separate retaining means slidably mounted on its bottom surface for retaining the body against movement with releasably holding means for releasably holding each of the retaining means in a retracted position on the body in which each of the retaining means does not extend beyond the periphery of the body and an extended position in which each of the retaining means extends a selected distance beyond the periphery of the body. The two separate retaining means extend from opposite edges of the body when the two separate retaining means are in their extended positions. Each of the retaining means includes engaging means for engaging a surface of the fixed support beneath its upper e support surface to retain the drop-in device against movement when each of the retaining means is in its extended position.

An object of this invention is to provide an arrangement for retaining a drop-in device, which is disposed within an opening in a fixed support, in a desired position on the fixed support.

Another object of this invention is to provide an arrangement for retaining a cooktop, which is disposed within an opening in a counter top, in a desired position on the counter top.

Other objects of this invention will be readily perceived from the following description, claims, and drawings.

BRIEF DESCRIPTION OF THE DRAWINGS

The attached drawings illustrate a preferred embodiment of the invention, in which:

FIG. 1 is a perspective view, partly in section, of a pair of modular cooktops supported in a rectangular shaped opening in a counter top and retained in position by retaining means;

FIG. 2 is a fragmentary side elevational view partly in section, of one of the cooktops in FIG. 1 and showing it retained in the counter top;

FIG. 3 is a fragmentary bottom plan view of one of the clamping brackets of the retaining means in its maximum extended position;

FIG. 4 is a fragmentary bottom plan view of the clamping bracket of FIG. 3 in its retracted position; and FIG. 5 is an end elevational view of the clamping bracket of FIGS. 3 and 4 without an engaging screw.

DESCRIPTION OF THE PREFERRED EMBODIMENT

Referring to the drawings and particularly FIG. 1, there are shown two adjacent modular cooktops 10, which are drop-in devices, for support by a counter top 11, which is a fixed support. Each of the cooktops 10, which is preferably a rectangular shaped body 12, has one or more heating elements 12' such as gas burners or electric heating elements mounted therein. The heating elements 12' are supported in openings formed for that purpose in an upper surface 13 of the cooktop 10.

The upper surface 13 of each of the cooktops 10 has a rolled over edge formed along its front and rear edges providing outwardly extending flanges 14 and 16 (see FIG. 2), respectively. As shown in FIG. 1, the two cooktops 10 are disposed closely adjacent each other with a joiner strip 34 disposed therebetween spanning the space between their adjacent side edges to close off any gaps therebetween.

The counter top 11 has a rectangular shaped opening 18 (see FIG. 2) therein and extending therethrough to receive the cooktops 10. The opening 18 is only slightly larger than the peripheries of the abutting cooktops 10 beneath the flanges 14 and 16. When each of the cooktops 10 is inserted into the opening 18 in the counter top 11, the flanges 14 and 16 of each of the cooktops 10 rest on an upper surface 19 of the counter top 11 for support thereby and constitute an upper support portion of the cooktop 10.

The upper surface 13 of the cooktop 10 also extends laterally at its outer side edges to overlap the counter top 11. However, due to the rolled over front and rear edges forming flanges 14 and 16 of the upper surface 13 of the cooktop 10, a vertical gap exists between the outer side edges of upper surface 13 and the upper surface 19 of the counter top 11. A finishing strip 33 (see FIG. 1) is applied to the outer side edges of the upper surface 13 of the cooktops 10 to close this gap. When there is only one of the cooktops 10 in the opening 18 (See FIG. 2) in the counter top 11, one of the finishing strips 33 is provided along each of the side edges of the upper surface 13 of the cooktop 10.

Each of the cooktops 10 has two clamping brackets 20 and 21, which are the same, adjustably mounted on its bottom wall or surface 22. Each of the clamping brackets 20 and 21 includes a base 23 (see FIG. 5) having a pair of downwardly depending legs 24 and 25 at its opposite sides.

The base 23 has two aligned, elongated slots 26 (see FIGS. 3 and 4) and 27 formed therein and substantially parallel to the legs 24 (see FIG. 5) and 25. Each of the slots 26 (see FIG. 3) and 27 receives a self-threading screw 28 for disposition within a hole 29 (see FIG. 2) punched in the bottom wall or surface 22 of the cooktop 10.

The clamping bracket 20 is in its retracted position in FIG. 4 in which no portion of the clamping bracket 20 extends beyond front edge 15 of the cooktop 10. The clamping bracket 21 (see FIG. 2) is similarly disposed in its retracted position relative to rear edge 17 of the cooktop 10. Thus, when each of the two cooktops 10 is disposed within the opening 18 in the counter top 11, the opening 18 has to be only slightly larger than the overall peripheries of the two adjacent cooktops 10 since the clamping brackets 20 and 21 do not extend beyond the front edge 15 and the rear edge 17, respectively, of each of the cooktops 10.

The base 23 (see FIG. 5) of the clamping bracket 20 has a weld nut 30 secured thereto by welding at its end closest to the front edge 15 (see FIG. 2) of each of the cooktops 10. The clamping bracket 21 is similarly formed with another of the weld nuts 30.

After the two cooktops 10 (see FIG. 1) are positioned within the opening 18 (see FIG. 2) in the counter top 11 as shown in FIG. 1, the screws 28 (see FIG. 4) are released from their holding position for releasably holding the clamping bracket 20 and the clamping bracket 21 (see FIG. 2). With the screws 28 (see FIG. 4) no longer holding the clamping brackets 20 and 21 (see FIG. 2) in their retracted positions, each of the clamping brackets 20 and 21 on each of the cooktops 10 can be moved to extend a selected distance beyond the front edge 15 and the rear edge 17, respectively, of each of the cooktops 10.

The maximum extended position of each of the clamping brackets 20 and 21 is shown in FIG. 3 for the clamping bracket 20. In this maximum extended position, each of the elongated slots 26 and 27 has its inner edge engage one of the screws 28.

With the clamping bracket 20 in its extended position of FIGS. 1, 2, and 3, a long screw 31 (see FIG. 2) is threaded through the weld nut 30 on the clamping bracket 20 and into engagement with a bottom surface 32 of the counter top 11. Another of the long screws 31 is threaded through the weld nut 30 on the clamping bracket 21 for engagement with the bottom surface 32 of the counter top 11.

The engagement of the long screws 31 with the bottom surface 32 of the counter top 11 causes each of the flanges 14 and 16 to fit flat against the upper surface 19 of the counter top 11. Because the clamping brackets 20 and 21 are only movable in substantially parallel directions along the longitudinal axis of the elongated slots 26 (see FIG. 3) and 27, there can be no play or pivotal motion of each of the cooktops 10 (see FIG. 1) relative to the counter top 11.

If desired, the opening 18 (see FIG. 2) in the counter top 11 can be large enough to accommodate more than two of the cooktops 10 or smaller to accommodate only one of the cooktops 10. Because of the clamping brackets 20 and 21 extending only from the front edge 15 and the rear edge 17, respectively, the cooktops 10 can be disposed closely adjacent each other.

An advantage of this invention is that a drop-in device can be easily installed in a fixed support. Another advantage of this invention is that two or more drop-in devices can be arranged side by side in an opening in a fixed support. A further advantage of this invention is that each of the clamping brackets is adjustable to various extensions and is positively retained in its extended position.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A drop-in device for disposition in an opening in a fixed support including an upper support surface, said drop-in device including:

a body having a lower portion with a periphery slightly smaller than the opening in the fixed support in which said body is to be disposed;

said body having an upper support portion larger than the opening in the fixed support for engaging the upper support surface of the fixed support to support said drop-in device on the fixed support when said lower portion of said body is disposed in the opening in the fixed support;

said lower portion of said body having a bottom surface having two separate retaining means slidably mounted thereon for retaining said body against movement;

releasably holding means for releasably holding each of said two separate retaining means in a retracted position on said body in which each of said two separate retaining means does not extend beyond the periphery of said lower portion of said body and an extended position in which each of said two separate retaining means extends a selected distance beyond the periphery of said lower portion of said body when slidably moved from said retracted position;

each of said two separate retaining means being movable only in a non-pivoting sliding motion between said retracted and extended positions and substantially parallel to said bottom surface of said lower portion of said body;

said two separate retaining means extending from opposite edges of said body when said two separate retaining means are in their extended positions; and each of said two separate retaining means including engaging means for engaging a lower surface of the fixed support beneath said upper support surface to retain said drop-in device against movement when each of said two separate retaining means is in its extended position.

2. The drop-in device according to claim 1 in which each of said two separate retaining means is slidably mounted for movement in a direction substantially parallel to the direction of movement of the other of said two separate retaining means.

3. The drop-in device according to claim 2 in which:

said body has one of said two separate retaining means mounted adjacent said front edge; and said body has the other of said two separate retaining means mounted adjacent said rear edge.

4. The drop-in device according to claim 3 in which each of said two separate retaining means includes enabling means for enabling each of said releasably holding means to releasably hold said two separate retaining means at different selected distances beyond the periphery of said lower portion of said body.

5. The drop-in device according to claim 4 in which:

each of said two separate retaining means includes a bracket having a pair of elongated slots;

said body has two pair of holes in said bottom surface;

said elongated slots in each of said brackets is aligned with one of said pair of holes;

each of said releasably holding means includes a separate retaining screw disposed in each of said elongated slots in said bracket and one of said pair of holes in the bottom surface of said body with which said elongated slot is aligned; and said engaging means includes movable means supported on said bracket for movement into engagement with the lower surface of the fixed support.

6. The drop-in device according to claim 5 in which said movable means on each of said brackets includes a threaded member supported by said bracket for rotation relative thereto.

7. The drop-in device according to claim 6 in which each of said brackets has a threaded nut secured thereto to support said threaded member for rotation relative to said bracket.

8. The drop-in device according to claim 1 in which:
said drop-in device is a cooktop; and
the fixed support is a counter top.

9. In combination:
a drop-in device;
a fixed support having:
an upper support surface;
a lower surface beneath said upper support surface and in spaced relation thereto; and
an opening extending through said fixed support from said upper support surface to at least said lower surface;
said drop-in device including a body having a lower portion for disposition in said opening in said fixed support, said lower portion having a periphery slightly smaller than said opening in said fixed support;
said boy having an upper support portion larger than said opening in said fixed support and resting on said upper support surface of said fixed support when said lower portion of said body is disposed in said opening in said fixed support;
said lower portion of said body having a bottom surface having two separate retaining means slidably mounted thereon for retaining said body against movement when said body is supported by said fixed support;
releasably holding means for releasably holding each of said two separate retaining means in a retracted position on said body in which each of said two separate retaining means does not extend beyond the periphery of said lower portion of said body and an extended position in which each of said two separate retaining means extends a selected distance beyond the periphery of said lower portion of said body when slidably moved from said retracted position;
each of said two separate retaining means being movable only in a non-pivoting sliding motion between said retracted and extended positions and substantially parallel to said bottom surface of said lower portion of said body;
said two separate retaining means extending from opposite edges of said body when said two separate retaining means are in said extended positions; and
each of said two separate retaining means including engaging means for engaging said lower surface of said fixed support to retain said drop-in device against movement when each of said two separate retaining means is in said extended position.

10. The combination according to claim 9 in which each of said two separate retaining means is slidably mounted for movement in a direction substantially parallel to the direction of movement of the other of said two separate retaining means.

11. The combination according to claim 10 in which:
said body has one of said two separate retaining means mounted adjacent said front edge; and
said body has the other of said two separate retaining means mounted adjacent said rear edge.

12. The combination according to claim 11 in which each of said two separate retaining means includes enabling means for enabling each of said releasably holding means to releasably hold said two separate retaining means at different selected distances beyond the periphery of said lower portion of said body.

13. The combination according to claim 12 in which:
each of said two separate retaining means includes a bracket having a pair of elongated slots;
said body has two pairs of holes in its bottom surface;
said elongated slots in each of said brackets is aligned with one of said pair of holes;
each of said releasably holding means includes a separate retaining screw disposed in each of said elongated slots in said bracket and one of said pair of holes in the bottom surface of said body with which said elongated slot is aligned; and
said engaging means includes movable means supported on said bracket for movement into engagement with said lower surface of said fixed support.

14. The combination according to claim 13 in which said movable means on each of said brackets includes a threaded member supported by said bracket for rotation relative thereto.

15. The combination according to claim 14 in which each of said brackets has a threaded nut secured thereto to support said threaded member for rotation relative to said bracket.

16. The combination according to claim 9 in which:
said drop-in device is a cooktop; and
said fixed support is a counter top.

17. In combination:
a fixed support having:
an upper support surface;
a lower surface beneath said upper support surface and in spaced relation thereto; and
an opening extending through said fixed support from said upper support surface to at least said lower surface;
at least two cooktops adjacent each other;
each of said cooktops including a body having a lower portion for disposition in said opening in said fixed support, said lower portion of said body of each of said cooktops having a periphery smaller than said opening in said fixed support so that said lower portion of said body of each of said cooktops can be disposed in said opening in said fixed support at the same time;
said body of each of said cooktops having an upper support portion extending from at least a front edge and a rear edge so as to be larger than said opening in said fixed support in at least two opposite directions, said upper support portion resting on said upper support surface of said fixed support when said lower portion of said body is disposed within said opening in said fixed support;
said lower portion of said body of each of said cooktops having a bottom surface having two separate retaining means slidably mounted thereon for retaining said body against movement;
said body of each of said cooktops having one of said two separate retaining means mounted adjacent said front edge and the other of said two separate retaining means mounted adjacent said rear edge;
releasably holding means for releasably holding each of said two separate retaining means in a retracted position on said body in which each of said two separate retaining means does not extend beyond the periphery of said lower portion of said body and an extended position in which each of said two separate retaining means extends a selected distance beyond the periphery of said body when slidably moved from said retracted position;

each of said two separate retaining means being movable only in a non-pivoting sliding motion between said retracted and extended positions and substantially parallel to said bottom surface of said lower portion of said body;

said one of said two separate retaining means extending from the front edge of said body and said other of said two separate retaining means extending from the rear edge of said body when said two separate retaining means are in said extended positions; and each of said two separate retaining means on said body of each of said cooktops including engaging means for engaging said lower surface of said fixed support to retain said cooktop against movement when each of said two separate retaining means is in said extended position.

18. The combination according to claim 17 in which:

each of said two separate retaining means on said body of each of said cooktops includes a bracket having a pair of elongated slots;

each of said bodies has two pairs of holes in said bottom surface;

said elongated slots in each of said brackets is aligned with one of said pair of holes;

each of said releasably holding means includes a separate retaining screw disposed in each of said elongated slots in said bracket and one of said pair of holes in the bottom surface of said body with which said elongated slot is aligned; and said engaging means includes movable means supported on said bracket for movement into engagement with said lower surface of said fixed support.

19. The combination according to claim 18 in which said movable means on each of said brackets includes a threaded member supported by said bracket for rotation relative thereto.

20. The combination according to claim 19 in which each of said brackets has a threaded nut secured thereto to support said threaded member for rotation relative to said bracket.

* * * * *